US005141232A

United States Patent [19]

Durso

[11] Patent Number: 5,141,232

[45] Date of Patent: Aug. 25, 1992

[54] GOLF SWING TRAINING SYSTEM AND METHOD

[76] Inventor: Joseph M. Durso, 2224-B Springwood Dr., Reston, Va. 22081

[21] Appl. No.: 724,916

[22] Filed: Jul. 2, 1991

Related U.S. Application Data

[60] Division of Ser. No. 642,160, Jan. 17, 1991, abandoned, which is a continuation-in-part of Ser. No. 542,774, Jun. 25, 1990, abandoned.

[51] Int. Cl.[5] ..... A63B 69/36

[52] U.S. Cl. ..... 273/187 R; 33/452; 33/475; 33/478; 33/508; 273/DIG. 30

[58] Field of Search ..... 33/452, 474, 475, 478, 33/508; 273/187 R, 187 A, 187 B, 186 R, 186 C, 183 A, 183 B, 183 E, DIG. 30

[56] References Cited

U.S. PATENT DOCUMENTS 1,517,555 12/1924 Graham ..... 33/508
2,608,765 9/1952 Doud ..... 33/475
3,063,718 11/1962 Steinkamp ..... 273/DIG. 30
3,094,330 6/1963 Smith ..... 273/54 D
4,257,607 3/1981 Nedwick ..... 273/DIG. 30

*Primary Examiner*—George J. Marlo
*Attorney, Agent, or Firm*—Christopher J. Rudy

[57] ABSTRACT

A golfer's square includes a ball position pointer or the like. The ball position pointer includes an elongate substantially parallel-sided pivotable rule with a pivot end and a pointer distal to the pivot end, and the ball position pointer or the like is rightly attached to an elongate substantially parallel-sided right rule attachable to the pivotable rule, with hook and loop material such as VELCRO (Reg. U.S. Pat. & Tm. Off.), to make the golfer's square. The golfer's square or the ball position pointer may be used separately in methods to assist the golfer align his stance properly. A protruding right angle edge may be provided on the right rule to faciliate orienting both rules prior to attaching same together.

4 Claims, 4 Drawing Sheets

GOLF SWING TRAINING SYSTEM AND METHOD

CROSS-REFERENCE

This is a divisional of U.S. patent application Ser. No. 07/642,160 filed Jan. 17, 1991, now abandoned which is a continuation-in-part of U.S. patent application Ser. No. 07/542,774 filed Jun. 25, 1990, now abandoned.

FIELD

This invention concerns a golf practice article, its preparation and use. The invention is a useful amusement.

BACKGROUND

Golf is one of the most difficult to play of popular games in the world. It generally requires specific instruction, repeated application, i.e., perfect practice, concentration, and success under the pressure of competition in order to feel confidently skilled at every aspect of the game. For golfers this can be, and in many cases is, a lifelong endeavor. Lack of time, patience and discipline, compounded by the lack of a convenient place to practice, make it difficult for most golfers to practice effectively, as they must, to improve the score of their game. Unfortunately, often when most golfers do practice, imperfect practice renders much of the time and effort spent of little if any value because such imperfect efforts cannot be repeated with success on the golf course under the pressure of playing conditions. Like a person aspiring to learn to play the piano well, golfers must get specific instruction and then follow a rigorous practice schedule to gain repeatable proficiency. However, while the piano student knows that the keyboard will be the same in both practice and in concert, golfers contend with variables in play that can nullify the hardest practice efforts or that can even start bad habits that must be overcome to be successful. The basic result is that average scores seldom vary more than three or four strokes over a typical golfer's lifetime.

SUMMARY

The present invention provides a golfer's square device comprising the following components: 1) a ball position pointer having a substantially elongate parallel-sided shaped rule with a pivot end and a pointer distal to the pivot end; 2) an elongate substantially parallel-sided right rule rightly attachable to the rule of said pointer at a position distal to its pivot end, and 3) means for attaching the rules such that the rules are thus readily rightly attachable to and detachable from one another, said means being a hook and loop material or the like. The ball position pointer may be adapted to be pivotably associatable with a base having a hitting surface for striking golf balls with a golf club. Also provided is a method for providing golf swing instruction comprising swinging or directing swinging of a golf club at a golf ball placed on a surface in suitable alignment with a substantially elongate parallel-sided shaped rule with the ball position pointer or the golfer's square,, provided that said pointer or square is used away from a golf swing training system device pad.

This invention is a useful amusement, for golf.

DRAWINGS

The drawings form part of the specification hereof. In the drawings like reference numerals refer to like features.

FIG. 2 is a perspective view of a golfer's square training device of the present invention, for straight tee shot training for the right-handed golfer, addressing the ball.

ILLUSTRATIVE DETAIL

Figure 1:
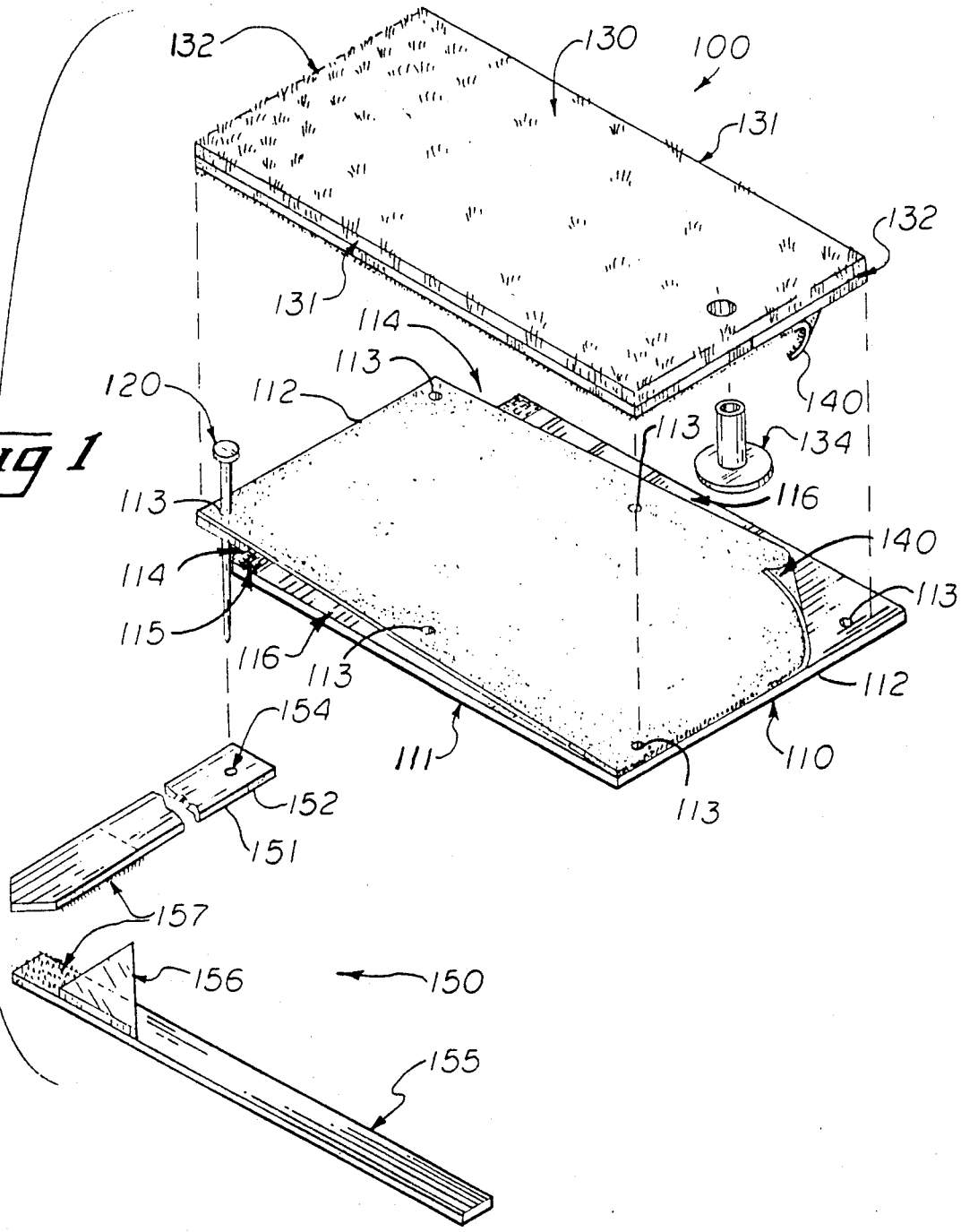
FIG. 1 is a perspective view of a golf swing training device, associated with a golf swing training device pad, of the present invention, separated.
Figure 5:
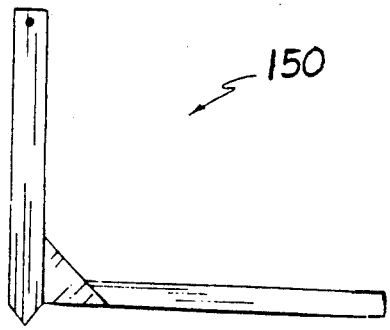
FIG. 5 is a top view of a golfer's square training device, assembled, of the present invention.
Figure 2:
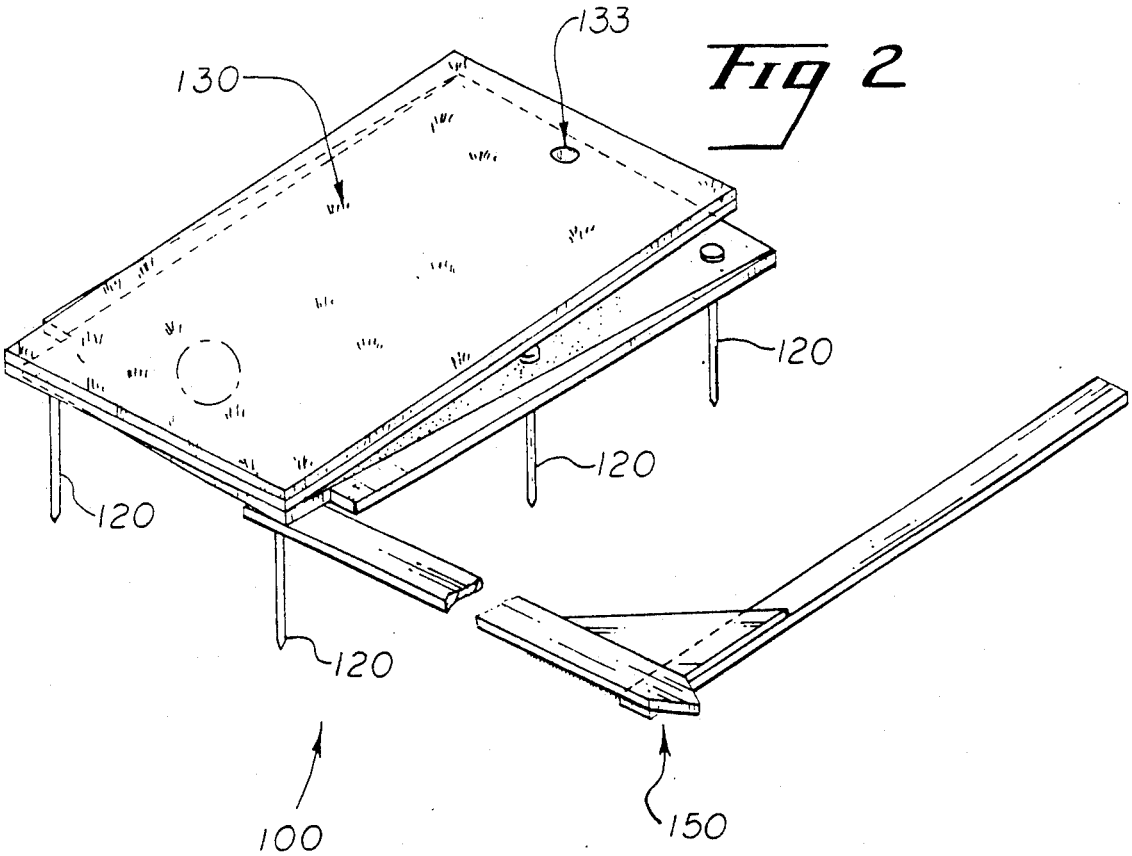
FIG. 2 is a perspective view of the golf swing training device generally of FIG. 1, as attached for fade shot training for a right-handed golfer.
Figure 3:
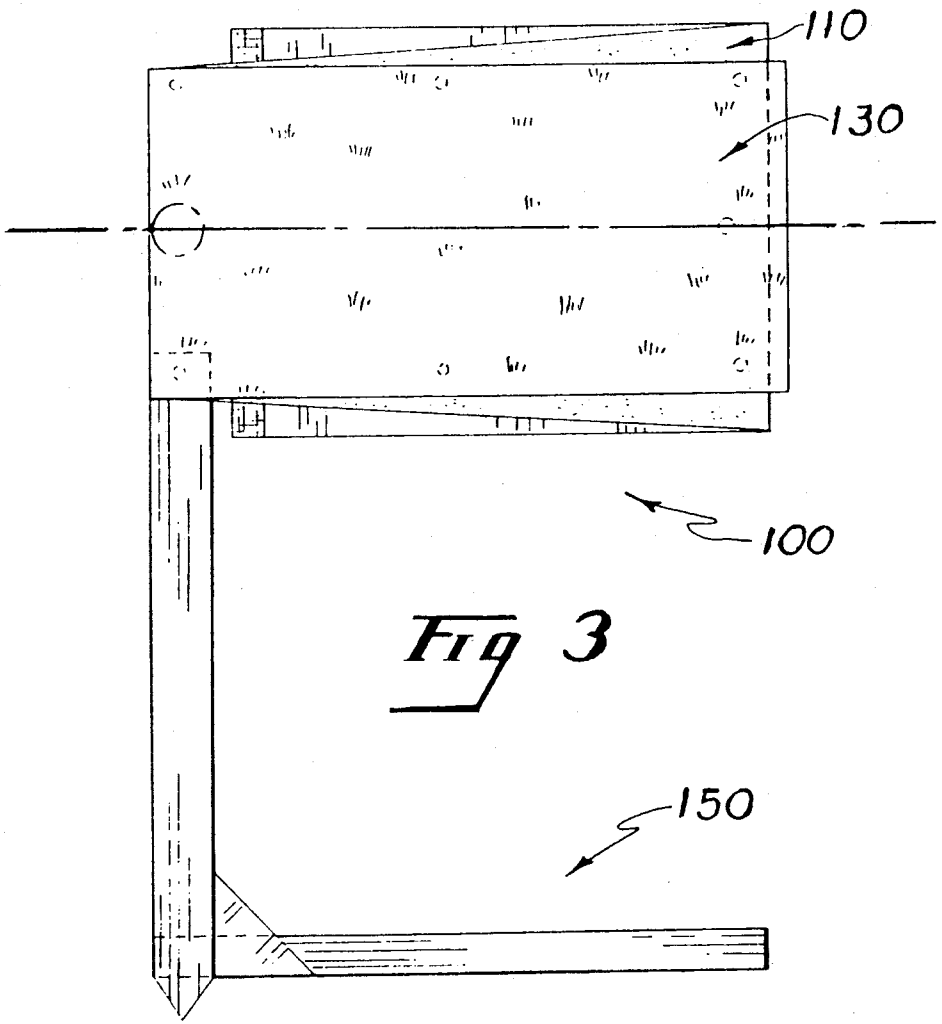
FIG. 3 is a top plan view of the golf swing training device of FIG. 2, as attached for straight shot training for the right handed golfer.
Figure 4:
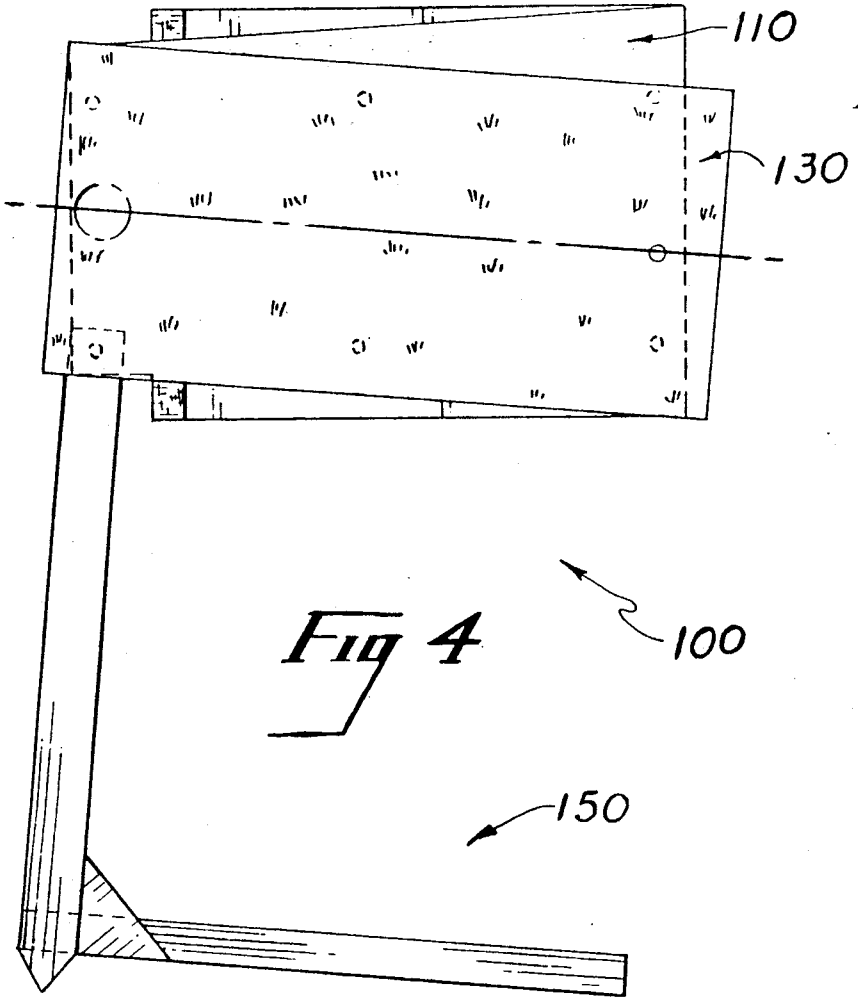
FIG. 4 is a top plan view of the golf swing training device of FIG. 2, as attached in position for draw shot training for the right-handed golfer.
Figure 6:
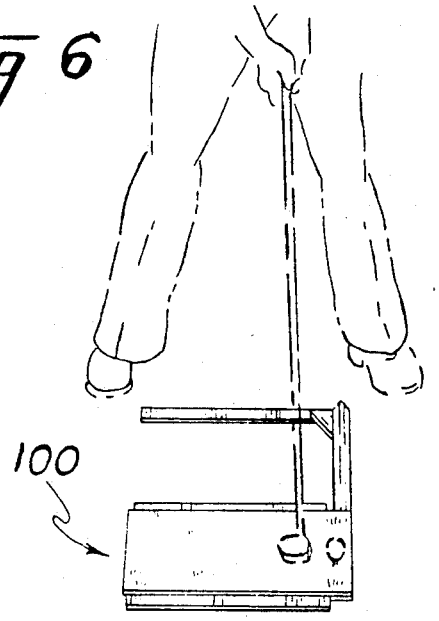
FIG. 6 is a perspective view of a golf swing training device of the present invention, as attached for straight tee shot training for the right-handed golfer, addressing the ball, which is a perspective view of a golfer's square training device of the present invention, as attached with a pad device for straight tee shot training for the right-handed golfer, addressing the ball.
Figure 7:
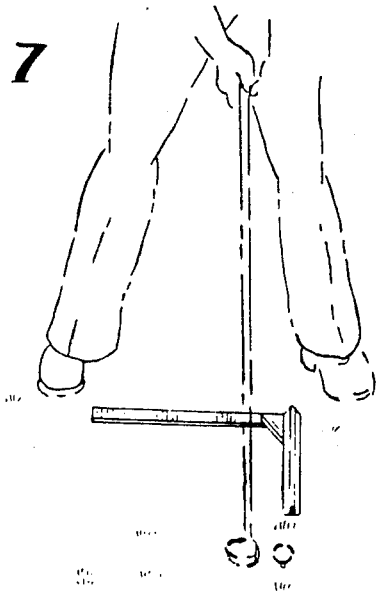
Figure 8:
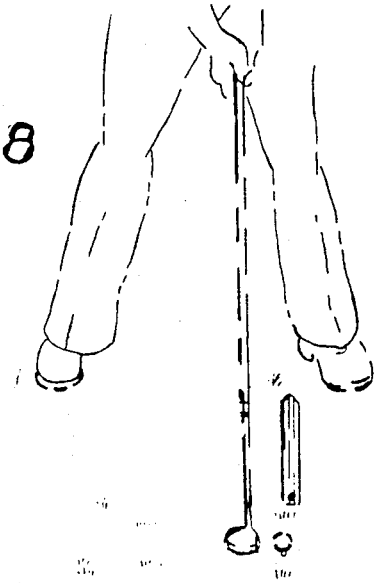
FIG. 8 is a perspective view of a ball position pointer training device of the present invention, for straight tee shot training for the right-handed golfer, addressing the ball.
Figure 9:
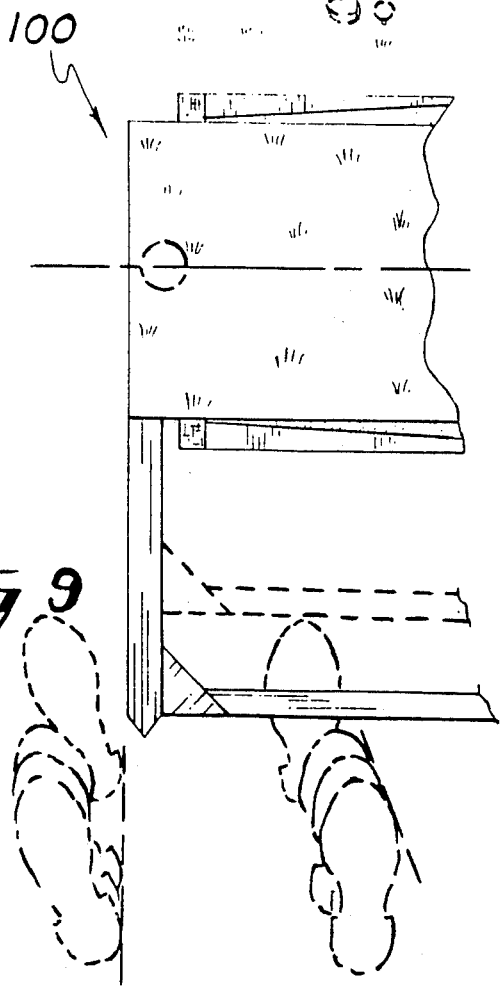
FIG. 9 is a top plan view of the device as generally depicted in FIG. 6 showing some of the positions that feet of the right-handed golfer may assume in golf swing training.

The present invention has several aspects.

In general, the golfer's square includes:

1) A ball position pointer or the like. The ball position pointer has an elongate substantially parallel-sided pivotable rule with a pivot end. It may optionally have a pointer distal to its pivot end. The ball position pointer may be pivotably associatable with a golf swing training device pad base and for such can be provided with a hole in its pivot end.

2) An elongate substantially parallel-sided right rule rightly attachable to that pivotable rule.

3) Means for attaching the rules.

Sundry embodiments are possible. For example, the golf swing training device pad of the parent invention, with which the golfer's square can be used to provide instruction with, can be a "pad" having the following components:

A) A flat substantially rectangular base having two forwardly directable edges a predetermined distance apart.

B) Means for securing the base to a practice surface.

C) A substantially rectangular hitting surface having two forwardly directable edges spaced apart a predetermined distance less than the predetermined distance between the two forwardly directable edges of the base. Alternatively, the two forwardly directable edges can be spaced apart a predetermined distance more than or the same distance as the predetermined distance between the two forwardly directable edges of the base.

D) Means for adjustably attaching the hitting surface to the base, which means is one such that alignment and shiftability of the hitting surface in relation to the base is permitted readily and repeatedly by lifting the hitting surface from the base prior to executing a swing of a golf club in conjunction with the pad yet such that anchoring of the hitting surface to the base is extant when the hitting surface is struck by the golf club in executing the golf swing.

Generally, such devices can be small. Preferably, the pad is at most about 2 feet (61 cm) along its forwardly directable edges by about 1 or so foot (30.5 cm) along its sidewardly directable edges, especially of its hitting surface, of course, with the distances along the sidewardly directable edges of the hitting surface generally being less than at least the rearward, e.g., non-notched, sidewardly directable edge of the base, by about 1½ inches (4 cm) in overall thickness, excluding any tee associatable therewith, and the ball position pointer is at most about 2 feet (61 cm) in length, and the said parallel-sided right rule of the golfer's square is at most about 2 feet (61 cm) in length.

The golf swing training device of the present invention can be made by known methods or processes. Accordingly, plastics, treated leathers or plastic imitations thereof, and so forth can be employed. Suitable plastic materials can include nylon, acrylate polymers, polyolefin polymers such as HDPE or LDPE, rigid or foamed PVC, and especially HYTREL, e.g., HYTREL 6356 (DuPont), an elastomeric block copolymer of polybutylene terephthalate and long-chain polyether glycols. As are known in the art, such plastics may be extruded and so forth, and other components such as, for example, 4-inch wide VELCRO hook and loop material, may be attached such as by gluing, sewing, and/or hot pressing, and so forth and the like, and final shapes can be obtained by cutting, drilling, and so forth and the like.

In reference to the drawings, one golf swing training device 100 has flat rectangular base 110 of a suitably strong, supple substance, e.g., a solid plastic or the like, of a light coloration, or white, having two forwardly directable edges 111 a predetermined distance apart, e.g., 10 inches (25.4 cm), along two sidewardly directable edges 112. These two forwardly and two sidewardly directable edges are parallel to each other, respectively, and right angles are made at the intersections of the edges. The two forwardly directable edges, e.g., 13 inches (33 cm), not including additional length attributable to any notch which may be present, are longer than the two sidewardly directable edges, e.g., 10 inches (25.4 cm). Holes 113, e.g., ¼ inch (0.635 cm) in diameter, six each, are in the base. Notches 114, preferably symmetrical, e.g., each cut or molded to be 1 inch (2.54 cm) along the sidewardly directable edges by 2 inches (5.08 cm) along the forwardly directable edges, define that end of the base which is to be forwardly directed, i.e., in the direction of the flight of the struck ball. The notches can be useful for accommodating the ball position pointer pivotably associatable with the base and/or for presentation of a golf ball for ready alignment of a golf club used for striking the ball. Golf club alignment indicia 115, e.g., bright yellow or especially red lines ½ inch (1.27 cm) wide, are present on the base directly behind these notches to help remind a golfer to align the golf club face square to the target before starting a backswing. Forwardly directed border 116 is present. Means 120 for securing the base to a practice surface is provided, e.g., by six flat headed 8-inch (20.32-cm) by ¼-inch (0.635-cm) aluminum spikes, which are driven into the practice surface, e.g., natural sod or turf, through the holes in the base to hold the base firmly even when the golf swing training device is struck during a golf swing. Rectangular hitting surface 130 is artificial but in imitation of the color and rough feel of natural turf grass, e.g., of nylon ASTRO TURF, or the like, which may be backed by a resilient or rubbery substance, especially when employed by beginning golfers where the backing may generally increase in thickness the less experienced the golfer is, but which backing is preferably absent, and has two forwardly directable edges 131 spaced apart a predetermined distance, e.g., 8 inches (20.32 cm) along two sidewardly directable edges 132. The distance along edges 131, e.g., 15½ inches (39.37 cm), is typically slightly longer than the distances along edges 111, e.g., 15 inches (38.1 cm), and the distances along edges 132, e.g., 8 inches (20.32 cm) are less than distance along edges 112, e.g., 10 inches (25.4 cm), to leave the forwardly directed border on the base. Too, these forwardly and sidewardly directable edges of the hitting surface are parallel to each other, respectively; right angles are made at the intersections of the edges, and the two forwardly directable edges are longer than these two sidewardly directable edges. The hitting surface has tee hole 133, e.g., ½ inch (1.27 cm) in diameter, in it near, e.g., 1 inch (2.54 cm) from, a sidewardly directable edge and equidistant from its forwardly directable edges. The tee hole is for insertion of a rubber tee 134 therethrough. Means 140 for adjustably attaching the hitting surface to the base is provided, e.g., by VELCRO pieces or the like, which include separate hook and loop portions suitably attachable to the base and the hitting surface, to make up an area 8 inches (20.31 cm) by 15 inches (38.1 cm) as from the use of two commercially available 4-inch (10.16-cm) wide strips, side-by-side, glued to the upper side of the base, equidistant from the two forwardly directed edges to leave two parallel 1-inch (2.54-cm) lightly colored, or white, borders, and glued to the under side of the entire hitting surface, with the hooked piece of the VELCRO thus glued onto the base and the looped piece of the VELCRO thus glued onto the hitting surface. Golfer's square 150 has elongate parallel-sided pivotable rule 151, e.g., of the same ¼-inch (0.635-cm) plastic as the base but being about 15 inches (38.1 cm) by 1⅝ inches (4.1275 cm), having a pivot end 152 and a pointer 153 distal to the pivot end. This rule alone is an embodiment of the ball position pointer pivotably associatable with the base of the golf training device of this invention. This golfer's square can be pivotably connected to the base, e.g., by insertion of one of the spikes through distal hole 154, e.g., ¼ inch (0.625 cm) in diameter, and the appropriate corner hole of the base. Elongate parallel-sided right rule 155, e.g., of the same ¼ inch plastic as the base but in general being about 15 inches (38.1 cm) by 1 inch (2.54 cm), is rightly attachable to the pivotable rule, i.e., attachment of the rules can form a right angle therewith, between its ends but nearer to the pointer distal to the pivot end, e.g., as readily obtainable through right angle guide 156. Means 157 for attaching the rules is provided, e.g., by VELCRO pieces or the like glued to the lower side of the pointer-containing rule and the upper side of the right angle guide-containing rule.

In further reference to the drawings, salient dimensions of device embodiments of the present invention (e.g., A: With rigid or foamed PVC; B: With HYTREL 6356) can include general feature dimensions such as follows:

| | | |
|---|---|---|
| 110 | A) | Overall 6 × 11 inches (15 × 28 cm) and ¼ inch (6 mm) in thickness. |
| | B) | Overall 6 × 10¼ inches (15 × 26 cm) and 3/16 inch (4 mm) in thickness. |
| 111 | A) | 9 inches (23 cm) excluding notch. |
| | B) | 8 inches (20 cm). |
| 112 | A) | 6 inches (15 cm). |
| | B) | Back: 4 or 6 inches (10 or 15 cm) Forward: 4 inches (10 cm) by notch tapering to 2 inches (5 cm) at the forwardmost part. |
| 131 | A) | 11 inches (28 cm). |
| | B) | On center: 10¼ inches (15 × 26 cm). |
| 132 | A) | 4 inches (10 cm). |
| | B) | Back: 4 inches (10 cm) Forward: 4 inches (10 cm) by notch tapering to 2 inches (5 cm) at the forwardmost part. |
| 151 | A) | 11 inches (28 cm) in length and ⅛ inch (3 mm) in thickness. |
| | B) | 10 inches (25 cm). |
| 114 | (A & B) | 1 × 2 inches (2.5 × 5 cm). |
| 155 | (A & B) | About from 10 to 12 inches (15 to 31 cm). |

Also, the notches may be cut so that they have an obtuse angle, e.g., about from 110 to 120 degrees, rather than being only square, and the hitting surface can be formed to accommodate this shape. Rigid or rigid foam PVC, for example in comparison with some other suitable plastics, is generally less dense, can more readily accommodate gluing of such a material as, for example, VELCRO, thereto, and is nearly just as durable and weatherable if not more so. Nonetheless, with other plastics, e.g., HYTREL 6356 (DuPont), sewing of the material such as the VELCRO can provide excellent attachment of these components. Hot melt bonding may be employed. Furthermore, the device, e.g., especially with smaller dimensions, can be partially assembled and packaged as an insert in a binder, e.g., a 3-ring binder for accommodating letter- or A4-sized paper, in conjunction with pages of golf instruction. The device can be highly portable and adaptable as well.

In practice, the ball is preferably placed forward on the hitting surface or tee of the pad, with the hitting surface being aligned straight for straight shots, aligned with its forward end toward the inside for a deliberate fade, or slice, and aligned with its forward end toward the outside for a deliberate draw, or hook, always with the base remaining aligned straight toward the desired target. Preferably, the pointer is positioned at a right angle to the forward direction of the hitting surface, say, somewhat toward the inside of the golfer's forward heel, and the golfer's square is positioned parallel to the forward direction of the hitting surface behind the pointer or the like. The golfer lines up his feet and shoulders parallel with the rightly attachable rule of the golfer's square and thus with the initial line of flight, as defined by the forwardly directed sides of the base, of any good shot, whether it be straight, to include puts, or a fade or a draw. The golfer's feet are placed an appropriate distance apart and an appropriate distance from the ball such as in position to hit a wood shot, where the feet are generally positioned farthest apart and farthest from the ball, a short iron shot, where the feet are generally positioned closest together and closest to the ball, or a long or mid iron shot, where the feet are generally positioned somewhat between those two extremes. The invention is an excellent means of practicing the putting stroke. Another ball placed behind the ball to be struck may be drawn back the length of the hitting surface in excellent practice of a good backswing for wood or iron shots or for putting.

When it is desired to practice hitting balls off real grass, the pointer and/or golfer's square can be employed without the base, hitting surface, and so forth. The trained golfer merely places the pointer and/or golfer's square on the ground appropriately as otherwise in use with the base, hitting surface, and so forth, and begins practice, e.g., before a match with practice golf balls. If desired a tie may be placed into hole 154 to secure the device to the ground. At this time, all of the things learned by practicing with the present invention with its base, hitting surface, and so forth is applied to real turf conditions, but with the pointer and/or golfer's square weaning the golfer ever closer to no training device assistance at all.

In general thus, the present invention can help correct errors golfers make in setup and direction sighting, before the swing even begins. Golf in many ways is a game of optical illusions, and until the eye becomes trained, practicing golfers often think that they are lined up square to the target when actually they are aiming their shot to the right or to the left. The first aspects of the present invention solve the problem of incorrect alignment by visually prompting a golfer to set up square to the desired line of flight of the ball so that all of the aspects of a golf swing can work properly toward the desired outcome.

Some summarized advantages follow:

1) Ball-position pointer. This indicates the position of the forward heel in relation to the ball. It easily adjusts to maintain a proper right angle as the hitting surface is adjusted.

2) Golfer's square. This reminds the golfer of the proper lineup and stance.

3) Natural use. The golfer can stand on natural grass to practice swing so as to mimic golf course conditions. There are no functional distractions to be concerned with as the golfer practices.

4) Indoor use. The golfer may stand indoors to practice swing. The training benefits still apply and practice swings can be made without a ball or even with a plastic ball. A real ball can be used if the inside space is large enough for a net.

5) Putting. The golfer's square or the ball position pointer may be employed in training to help obtain a smooth, accurate putting stroke.

6) Instructable. Although it is a self-training device, the devices of this invention can be employed with professional instruction, books, and/or video taping.

7) Adaptable. The devices of the invention not only can be used indoors or out, but they also can be readily packaged and distributed, alone or in conjunction with other materials, for example, with a golf swing training pad, an instruction book, etc.

8) Effective. The invention, to include its methods, engenders good practice for the golfer.

Numerous further advantages inherently attend the invention.

CONCLUSION

The present invention is thus provided. Numerous adaptations and modifications can be effected by those of skill in the art within the spirit hereof, the scope of which is particularly pointed out by the following distinctly claimed subject matter.

What is claimed is:

1. A golfer's square device comprising:

A) a first component being a ball position pointer having a substantially elongate parallel-sided rule with a hole in one end thereof to form a pivot and a tapered opposite distal end to define a pointer, B) a second component being an elongate substantially parallel-sided rule, C) means for detachably attaching one end of the second component to said first component adjacent said tapered end, said means begin a hook and loop material, and a right angle edge protruding from one of said components for aligning said components at a right angle to each other prior to attaching said components together.

2. The device of claim 1, which is made of a suitable plastic material.

3. A method for providing old swing instruction comprising swinging or directing swinging of a golf club at a golf ball placed on the surface in suitable alignment with the device recited in claim 1.

4. The method of claim 3, carried out on natural turf.

* * * * *